US011427021B2

(12) United States Patent
Ferrara, Jr. et al.

(10) Patent No.: US 11,427,021 B2
(45) Date of Patent: Aug. 30, 2022

(54) SYSTEM AND METHOD FOR ATTENUATING INK SMEARS ON PRINTHEAD FACEPLATES DURING INKJET PRINTHEAD MAINTENANCE

(71) Applicant: Xerox Corporation, Norwalk, CT (US)

(72) Inventors: Joseph M. Ferrara, Jr., Webster, NY (US); David A. VanKouwenberg, Avon, NY (US); Jason M. LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 12 days.

(21) Appl. No.: 17/005,937

(22) Filed: Aug. 28, 2020

(65) Prior Publication Data

US 2022/0063313 A1 Mar. 3, 2022

(51) Int. Cl.
*B41J 29/38* (2006.01)
*B41J 25/316* (2006.01)

(52) U.S. Cl.
CPC ..... *B41J 25/316* (2013.01)

(58) Field of Classification Search
None
See application file for complete search history.

(56) References Cited

U.S. PATENT DOCUMENTS

2006/0132534 A1 6/2006 Ahne et al.
2009/0189945 A1* 7/2009 Sekiyama ..... B41J 2/16547 347/33
2011/0216127 A1 9/2011 Karppinen et al.
2012/0274701 A1 11/2012 Zhou et al.
2015/0298475 A1 10/2015 Kuypers et al.
2018/0201020 A1* 7/2018 Mori ..... B41J 25/316
2019/0126623 A1* 5/2019 Nishiyama ..... B41J 2/16538
2019/0308875 A1* 10/2019 Traub ..... B81C 1/00373
2020/0108620 A1 4/2020 Burke et al.
2020/0207130 A1* 7/2020 Matsuura ..... B25J 9/0093

FOREIGN PATENT DOCUMENTS

EP 0982142 A1 * 3/2000 ..... B41J 2/475

* cited by examiner

*Primary Examiner* — Erica S Lin
*Assistant Examiner* — Tracey M McMillion
(74) *Attorney, Agent, or Firm* — Maginot Moore & Beck LLP

(57) ABSTRACT

An inkjet printhead assembly includes a controller operatively connected to an actuator so the controller can operate the actuator to tilt a carrier plate in which a plurality of printheads are mounted after a purge of the printheads has been performed. The tilt assists gravity in directing the purged ink to a wiper that is moved by another actuator operated by the controller to wipe the faceplates of one or more printhead faceplates in the carrier plate. After the wiper is returned to its home position, the carrier plate is returned to its level position and the printhead assembly is returned to its operational position for printing.

9 Claims, 4 Drawing Sheets

SYSTEM AND METHOD FOR ATTENUATING INK SMEARS ON PRINTHEAD FACEPLATES DURING INKJET PRINTHEAD MAINTENANCE

TECHNICAL FIELD

This disclosure relates generally to inkjet printing systems, and more particularly, to the maintenance of the printheads in such printers.

BACKGROUND

Large scale inkjet printers perform long print runs with little down time and can be used over multiple shifts at a printing facility. During print production, the printheads in these printers require at regular intervals ink purges through the inkjets and a wipe of the printhead faceplates while the ink is still present on the faceplates to maintain proper jetting functionality and good image quality. The coating on the inkjet printheads in these printers is hydrophobic to prevent ink from leaking from the inkjet nozzles onto the faceplates. This hydrophobic coating causes ink to recede from the edges of the inkjet array in the faceplate and form large drips. Additionally, the inkjet nozzles are held at a small negative pressure after ink is expunged during the purge. This negative pressure also results in the ink receding further away from the edges of the inkjet array and back into the nozzles. When the purge is finished, the faceplate is wiped with an elastomeric wiper to remove the purged ink from the faceplate. This wiping occurs after a time delay from the end of the purge sequence due to system constraints within the printer. Consequently, at the beginning of the wipe, an amount ink may not present at the end of the inkjet array where the wipe begins sufficient to lubricate the wiper for a smooth wipe of the faceplate. Instead, the ink at the beginning of the wipe smears on the faceplate and this smeared ink can result partially close or otherwise impair the nozzles in the array that are located at the start of the wipe. These compromised or non-functional inkjets can result in poor image quality. Ensuring a quality wipe across the entire inkjet array would be beneficial.

SUMMARY

A new printhead assembly includes a mechanism that helps ensure a quality wipe across the entire surface of an inkjet array in a printhead faceplate. The printhead assembly includes a carrier plate having a length and a width, a plurality of printheads mounted in the carrier plate, a member configured for linear motion that is positioned at one end of the length of the carrier plate, a plurality of actuators, at least one actuator being operatively connected to the member configured for linear motion, and a controller operatively connected to the plurality of actuators. The controller is configured to operate the at least one actuator to move the member configured for linear motion to move the one end of the carrier plate and tilt the carrier plate and to operate the at least one actuator to reverse movement of the member configured for linear motion to return the carrier plate to a level position.

A new inkjet printer includes a printhead maintenance system that helps ensure a quality wipe across the entire surface of an inkjet array in a printhead faceplate. The inkjet printer includes an printhead assembly having a carrier plate with a length and a width, a plurality of printheads mounted in the carrier plate, a member configured for linear motion that is positioned at one end of the length of the carrier plate, a plurality of actuators, a first actuator being operatively connected to the member configured for linear motion, and a controller operatively connected to the plurality of actuators, the controller being configured to operate the first actuator to move the member configured for linear motion to move the one end of the carrier plate and tilt the carrier plate and to operate the first actuator to reverse the linear motion of the member configured for linear motion to return the carrier plate to a level position, and a wiper operatively connected to a second actuator in the plurality of actuators, the controller being further configured to operate the second actuator in the plurality of actuators to move the wiper from a first position across a faceplate of at least one printhead mounted in the carrier plate and to return the wiper to the first position after the wiper has traversed the faceplate of the at least one printhead.

A method of operating a printhead maintenance system in an inkjet printing system helps ensure a quality wipe across the entire surface of an inkjet array in a printhead faceplate. The method includes operating with a controller a first actuator in a plurality of actuators to move a member configured for linear motion and tilt a carrier plate in which a plurality of printheads are mounted, operating with the controller a second actuator in the plurality of actuators to move a wiper from a first position across a faceplate of at least one printhead mounted in the carrier plate and to return the wiper to the first position after the wiper has traversed the faceplate of the at least one printhead, and operating with the controller the at least one actuator to reverse the linear motion of the member configured for linear motion to return the carrier plate to a level position.

BRIEF DESCRIPTION OF THE DRAWINGS

The foregoing aspects and other features of an inkjet printing system and its method of operation that helps ensure a quality wipe across the entire surface of an inkjet array in a printhead faceplate are explained in the following description, taken in connection with the accompanying drawings.

DETAILED DESCRIPTION

Figure 1:
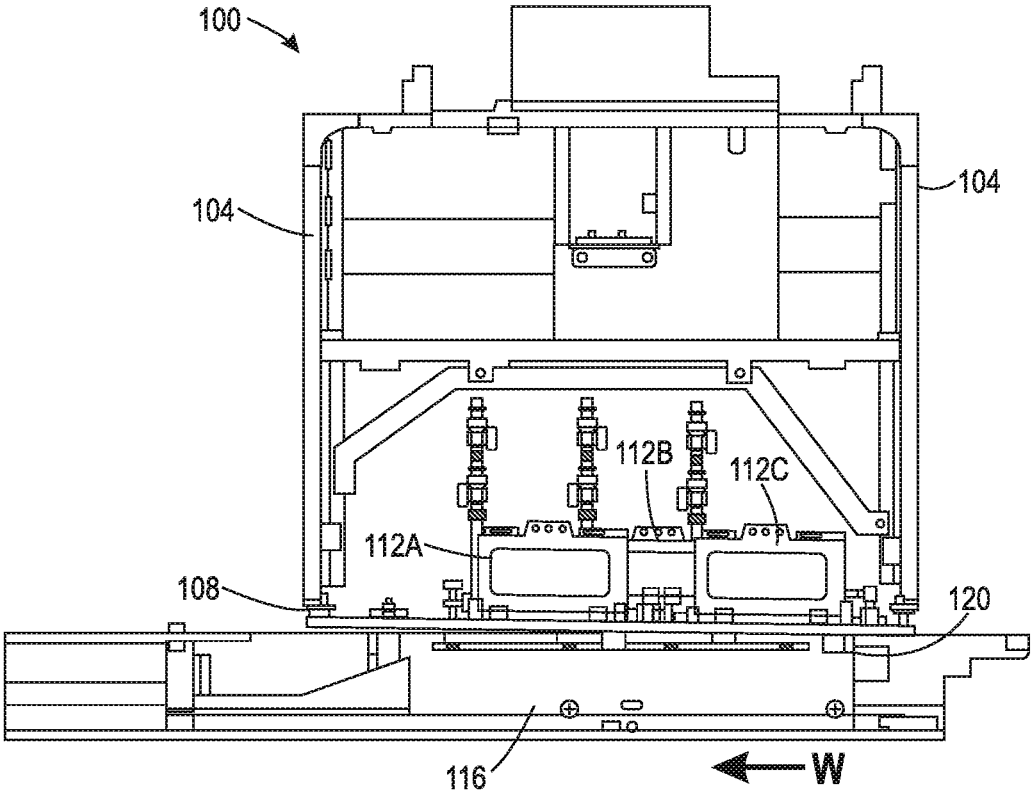
FIG. 1 is a sideview of a printhead assembly in an inkjet printing system that helps ensure a quality wipe across the entire surface of an inkjet array in a printhead faceplate.

For a general understanding of the present embodiments, reference is made to the drawings. In the drawings, like reference numerals have been used throughout to designate like elements.

FIG. 1 is a side view of a printhead assembly 100 in an inkjet printing system that helps ensure a quality wipe across the entire surface of an inkjet array in a printhead faceplate. The system 100 includes columnar supports 104 to which a printhead array carrier plate 108 is mounted. In the embodiment shown in FIG. 1, three printheads 112A, 112B, and 112C are mounted in an orientation that enables the inkjets in the printheads to eject drops of ink into printhead cap 116.

As used in this document, the term "carrier plate" means any structure that holds a plurality of printheads in precise registration with one another. The cap 116 mates with the carrier plate 108 to seal the environment of the inkjet arrays of the printheads 112A, 112B, and 112C when a purge cycle and faceplate wipe occurs. A wiper 120 is positioned at the home position shown in FIG. 1 to wipe the faceplates of the printheads in the direction W shown in the figure. As explained in more detail below, the carrier plate 108 is positioned with a tilt after a printhead purge as shown in FIG. 1 prior to the wiper 120 being moved to perform the faceplate wipe. The three printheads 112A, 112B, and 112C are arranged so the longitudinal axis of the inkjet arrays of printheads 112A and 112B are aligned but separated by a distance that corresponds to a length of printhead 112C. Printhead 112C is offset from the aligned longitudinal axes of printheads 112A and 112C so the three printheads form a single array of inkjets having a width of the largest media sheet that can be printed by the printhead assembly.

Figure 2:
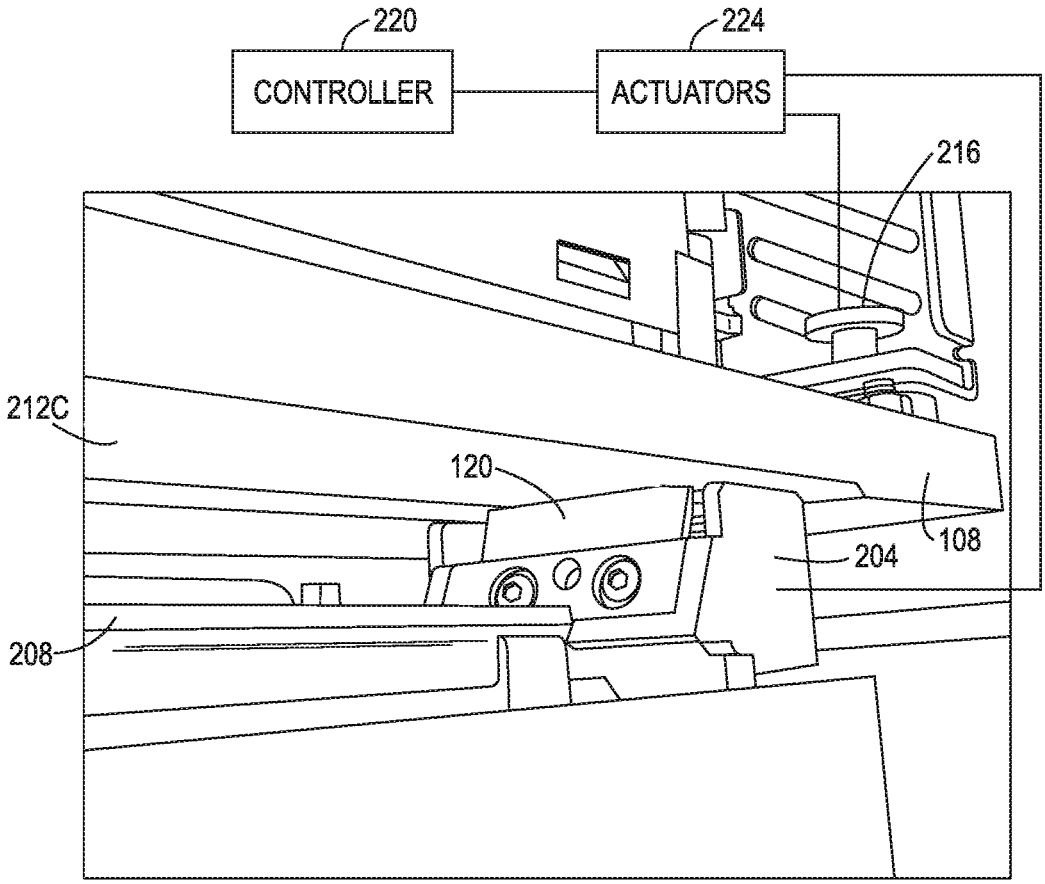
FIG. 2 is a bottom view of the wiper and carrier plate shown in FIG. 1.
Figure 3:
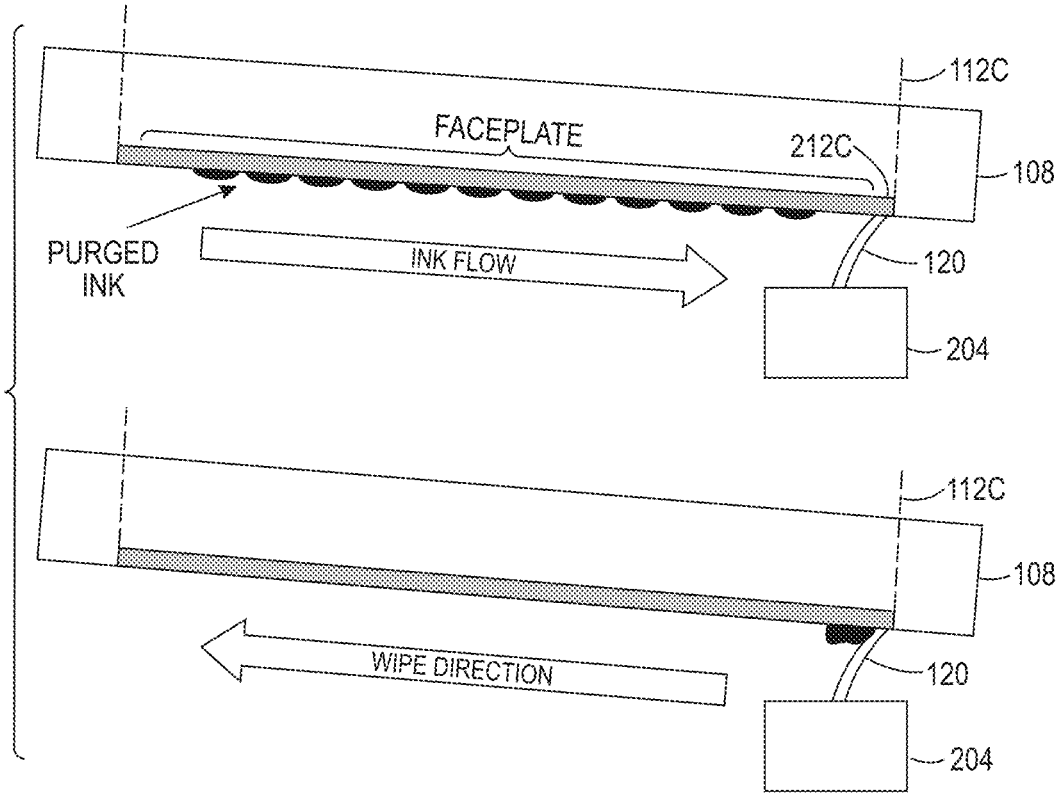
FIG. 3 is depiction of the effect of the carrier plate on the ink purged from the inkjets in the printheads of the printhead assembly in FIG. 1.

FIG. 2 shows the wiper 120 in its home position in more detail. The wiper 120 is fixedly mounted in a wiper carrier 204, which is slidably mounted to wiper slide 208 for reciprocating motion along the wiper slide to wipe the faceplate 212C of printhead 112C and the faceplate of printhead 112A (not shown in FIG. 2). To accomplish the movement of the wiper carrier and the tilting of the carrier plate 108, a controller 220 is operatively connected to a plurality of actuators 224 and these actuators are operatively connected to the wiper carrier 204 and a lead screw 216. The controller 220 operates at least one of the actuators 224 to rotate the lead screw 216 and advance the screw to push the end of the carrier plate nearest the wiper 120 toward the printhead cap 116. As used in this document, the term "lead screw" means any component that converts rotating motion into linear motion. Although the member that tilts the carrier plate and returns it to a level position is depicted as being a rotating member, it can also be a straight member that moves in a reciprocating linear manner. Following a printhead purge, this tilting of the carrier plate 108 enables the ink on the faceplates of the printheads to flow towards the end of the carrier plate nearest the home position of the wiper 120. This flow is facilitated by the hydrophobic coating on the inkjet arrays of the printheads 112A, 112B, and 112C. This hydrophobic coating on the faceplates of the printheads in the area in which the inkjet arrays are located tends to keep ink that collects on the faceplates of the printheads during printing operations between the nozzles in the faceplate and away from the ends of the inkjet arrays that are aligned with the longitudinal axes of the faceplates. By tilting the carrier plate 108, ink migrates towards the home position of the wiper 120 so ink contacts or very nearly contacts the wiper 120 at its home position. Thus, when the controller 220 operates another actuator 224 (FIG. 2) to slide the wiper carrier 204 along the wiper slide, relatively fresh ink lubricates the wiper 120 and helps clean, rather than smear, the faceplate 212C of the printhead 112C (FIG. 3). After the wiping is completed, the controller 220 operates the actuator 224 to return the wiper to its home position. The controller 220 then operates one of the actuators to rotate the lead screw 216 in the opposite direction it was rotated previously to return the carrier plate to its level position. The cap 116 can then be removed from the printhead assembly 100 so the assembly can be returned to its operational printing position. Although only wiper 120 for cleaning the faceplates of printheads 112C and 112A is shown in the figures, another wiper for cleaning printhead 112B is mounted in a wiper carrier slidably mounted to a wiper slide that is parallel to the wiper carrier 204 and wiper slide 208. Another actuator 224 is operated at the same time as the actuator 224 is operated to move the wiper 120 to move the wiper carrier for cleaning the faceplate of printhead 112B. In one embodiment, the tilt of the carrier plate is in a range of about one inch to about two inches below a horizontal axis of the carrier plate when the carrier plate is level.

Figure 4:
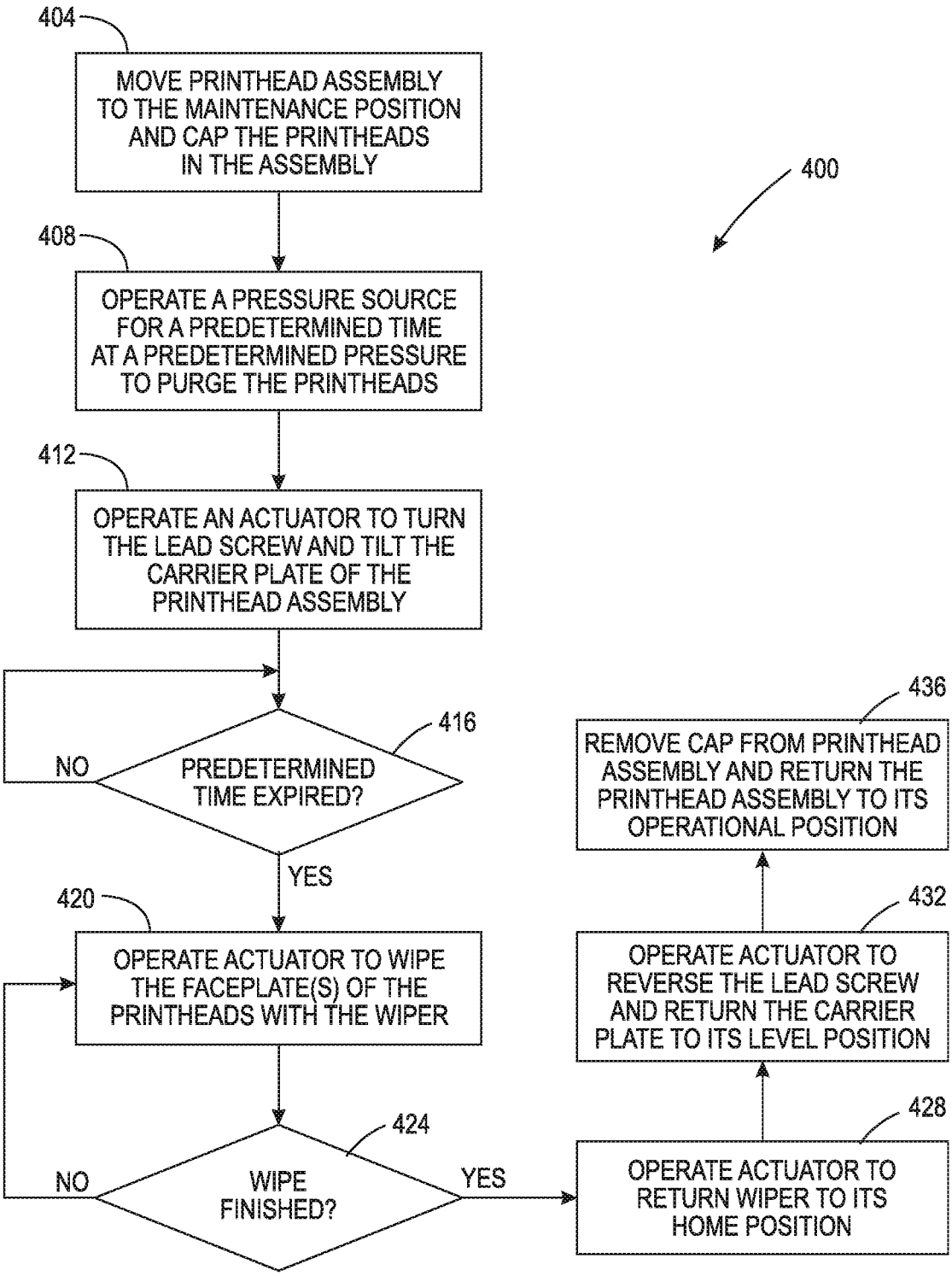
FIG. 4 is a flow diagram of a process for operating the printhead assembly of FIG. 1 and the wiper of FIG. 2 to ensure a quality wipe across the entire surface of an inkjet array in a printhead faceplate.

A process 400 for operating the print head assembly 100 and wiper 120 in manner that helps ensure a quality wipe across the entire surface of an inkjet array in a printhead faceplate is shown in FIG. 4. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 220 noted above can be such a controller or processor. Alternatively, the controller can be implemented with more than one processor and associated circuitry and components, each of which is configured to form one or more tasks or functions described herein. Additionally, the elements of the method may be performed in any feasible chronological order, regardless of the order shown in the figures or the order in which the processing is described.

The process 400 begins by moving the printhead assembly to its maintenance station and capping the printheads (block 404). A pressure source is then operated by the controller 220 for a predetermined time at a predetermined pressure to purge the inkjets in the printheads (block 408). Another actuator is operated to rotate the lead screw and tilt the carrier plate toward the wiper(s) (block 412). After the tilting of the carrier plate is completed and a predetermined time interval has expired (block 416), actuator(s) are operated to move the wiper(s) along the wiper slide(s) to clean the faceplates of the printheads (block 420). Once the wipe is finished (block 424), the actuator(s) that move the wiper(s) along the wiper slide(s) are reversed to return the wiper(s) to their home position(s) (block 428). The wipe is determined to be finished when the wiper passes the last inkjet array in the last printhead to be wiped by the wiper. The actuator that rotates the lead screw is operated to reverse the rotation of the lead screw and return the carrier plate to its level position (block 432). The printhead assembly is then uncapped and returned to its operational position for printing (block 436).

The predetermined time interval must be sufficient for a portion of the purged ink on the faceplate of the printhead nearest the wiper to flow towards the wiper and contact the wiper for lubrication at the commencement of the wiping action. In one embodiment, the predetermined time interval is about 25 to about 35 seconds with 30 seconds being a typical time interval for faceplates covered with a hydrophobic coating. Other time intervals can be used depending upon the amount of ink purged from the inkjets and the presence or absence of coatings on the faceplate of the printhead nearest the wiper.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printer comprising:

a printhead assembly having a carrier plate with a length and a width, a plurality of printheads mounted in the carrier plate, a member configured for linear motion that is positioned at one end of the length of the carrier plate, a plurality of actuators, a first actuator being operatively connected to the member configured for linear motion, and a controller operatively connected to the plurality of actuators, the controller being configured to operate the first actuator to move the member configured for linear motion to move the one end of the carrier plate from a level position and tilt the carrier plate so the one end of the length of the carrier plate is at a different gravitational potential than an opposite end of the length of the carrier plate and to operate the first actuator to reverse the linear motion of the member configured for linear motion to return the carrier plate to the level position; and a wiper operatively connected to a second actuator in the plurality of actuators, the controller being further configured to operate the second actuator in the plurality of actuators to move the wiper from a first position across a faceplate of at least one printhead mounted in the carrier plate while the carrier plate is tilted and to return the wiper to the first position after the wiper has traversed the faceplate of the at least one printhead and while the carrier plate is tilted.

2. The printer of claim 1 wherein the member configured for linear motion is also configured for rotation about a longitudinal axis of the member; and the controller is further configured to:

operate the first actuator to rotate the member configured for linear motion and rotation to tilt the carrier plate and to operate the first actuator to reverse rotation of the member configured for linear motion and rotation to return the carrier plate to the level position.

3. The printer of claim 2 wherein the member configured for linear motion and rotation about its longitudinal axis is a lead screw.

4. The printer of claim 3 wherein the tilt of the carrier plate is within a range of about one inch to about two inches below a horizontal axis when the carrier plate is at the level position.

5. The printer of claim 4 wherein each of the printheads in the plurality of printheads has a faceplate with an area in which an array of inkjets is located and a hydrophobic coating covers the area of each faceplate in which the array of inkjets is located.

6. The printer of claim 4, the controller being further configured to:

operate a pressure source operatively connected to the printheads in the printhead assembly to emit ink from the inkjets in the inkjet arrays onto the faceplates of the printheads before the first actuator is operated to tilt the carrier plate.

7. The printer of claim 6, the controller being further configured to:

wait a predetermined time interval after operating the first actuator to tilt the carrier plate so the emitted ink flows toward the first position of the wiper.

8. The printer of claim 7 wherein the predetermined time interval is sufficient for a portion of the emitted ink to contact the wiper at the first position.

9. The printer of claim 8 wherein the predetermined time interval is in a range of about 25 to about 35 seconds.

* * * * *